US005230647A

United States Patent [19]

Namba

[11] Patent Number: 5,230,647

[45] Date of Patent: Jul. 27, 1993

[54] REFLECTOR LAMP MANUFACTURING MACHINE

[75] Inventor: Masashi Namba, Yokosuka, Japan

[73] Assignee: Toshiba Lighting and Technology Corporation, Tokyo, Japan

[21] Appl. No.: 978,173

[22] Filed: Nov. 17, 1992

Related U.S. Application Data

[63] Continuation of Ser. No. 661,373, Feb. 28, 1991, abandoned.

[30] Foreign Application Priority Data

Feb. 28, 1990 [JP] Japan ..... 2-47796

[51] Int. Cl.[5] ..... H01J 9/44

[52] U.S. Cl. ..... 445/64; 445/4; 445/66

[58] Field of Search ..... 445/4, 22, 64, 66

[56] References Cited

U.S. PATENT DOCUMENTS 2,136,237 11/1938 Elmendorf ..... 445/64
2,154,500 4/1939 Elmendorf ..... 445/64
2,459,532 1/1949 Ickis ..... 445/4
4,310,772 1/1982 Tyler et al. ..... 445/4
4,429,249 1/1984 Tyler et al. ..... 445/4

FOREIGN PATENT DOCUMENTS 62-176045 8/1987 Japan .

*Primary Examiner*—Richard K. Seidel
*Assistant Examiner*—Jeffrey T. Knapp
*Attorney, Agent, or Firm*—Cushman, Darby & Cushman

[57] ABSTRACT

A machine for manufacturing reflector lamps comprising a reflector and lamp, having several holding heads for holding the reflector and lamp. A three-axis moving means is installed on each holding head. The three-axis moving means moves a lamp in the X-, Y-, and Z-axis directions to optically position the lamp, which has positioning means for positioning said lamp by detecting the luminous intensity distribution of the light projected forward from the reflector when the lamp is turned on and a securing means for securing the positioned lamp by cement.

3 Claims, 13 Drawing Sheets

REFLECTOR LAMP MANUFACTURING MACHINE

This is a continuation of application Ser. No. 07/661,373, filed on Feb. 28, 1991, which was abandoned upon the filing hereof.

BACKGROUND OF THE INVENTION

Field of the Invention

This invention relates to a method for manufacturing reflector lamps comprising a reflector and a light-source lamp. More particularly, the present invention relates to a machine for effectively manufacturing reflector lamps by automatically and efficiently assembling reflectors with lamps.

Description of the Related Art

In the conventional method for manufacturing a reflector lamp, a reflector and lamp are held by a positioning device and the lamp is set to a specified position of the reflector by turning on the lamp to detect the luminous intensity distribution of the light projected forward from the reflector by several illuminance meters and moving the lamp up to to the position where the specified luminous intensity distribution is obtained while an operator monitors values detected by these illuminance meters.

For this method, however, the operator requires dexterity and it takes time to position the lamp. Therefore, the operation is inefficient.

The lamp is normally secured to the reflector with adhesive or cement. However, it takes time for cement to cure. Therefore, the lamp must be held at the above specified position of the reflector until the cement cures.

Thus, the positioned reflector and lamp must be held by the positioning device until the cement cures. Fore this reason, manufacturing of reflector lamps becomes more inefficient. The present invention improves the above disadvantage and provides a machine for efficiently manufacturing reflector lamps.

SUMMARY OF THE INVENTION

The machine of the present invention has the following features for achieving the above object.

The machine of the present invention has several holding heads. These holding heads are installed, for example, on a turntable so that they will be moved by rotation of the turntable. These holding heads have a reflector and light-source lamp and three-axis moving means for moving the lamp around the reflector in directions of three axes X, Y, and Z which are orthogonal each other.

Also, the machine of the present invention has lamp positioning means for turning on said lamp, detecting luminous intensity distribution of the light projected forward from the reflector, automatically operating said three-axis moving means according to the luminous intensity distribution, and moving said lamp to the specified position.

Moreover, the machine of the present invention has temporary securing means for temporarily securing said lamp to the reflector.

The temporary securing means includes, for example, cement feeding means for feeding a small amount of cement to the lamp-mounting portion of the reflector and heating means for heating and curing the cement after the lamp is positioned.

According to another embodiment, said temporary securing means includes means for feeding quick-curing adhesive between the positioned lamp and the reflector.

In the machine of the present invention, said holding heads are moved, for example, by rotation of the turntable and the reflector is mounted before a small amount of cement is fed by said cement feeding means and then the lamp is mounted, turned on, and moved to the specified position by said lamp positioning means according to the luminous intensity distribution of the emitted light.

Then the cement is cured by said heating means and the lamp is temporarily secured at the specified position before the assembly of the reflector and lamp is finally secured by the cement newly fed in another process.

According to an embodiment of the present invention, the three-axis moving means of said holding head has only a slider to separately move in the X, Y, and Z directions and its moving system and motors for driving them are not installed on said turntable but are installed at the securing side. Therefore, these driving motors are connected with the three-axis moving means only when the holding head moves to the place for positioning said lamp.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention are described below according to drawings.

Figure 1:
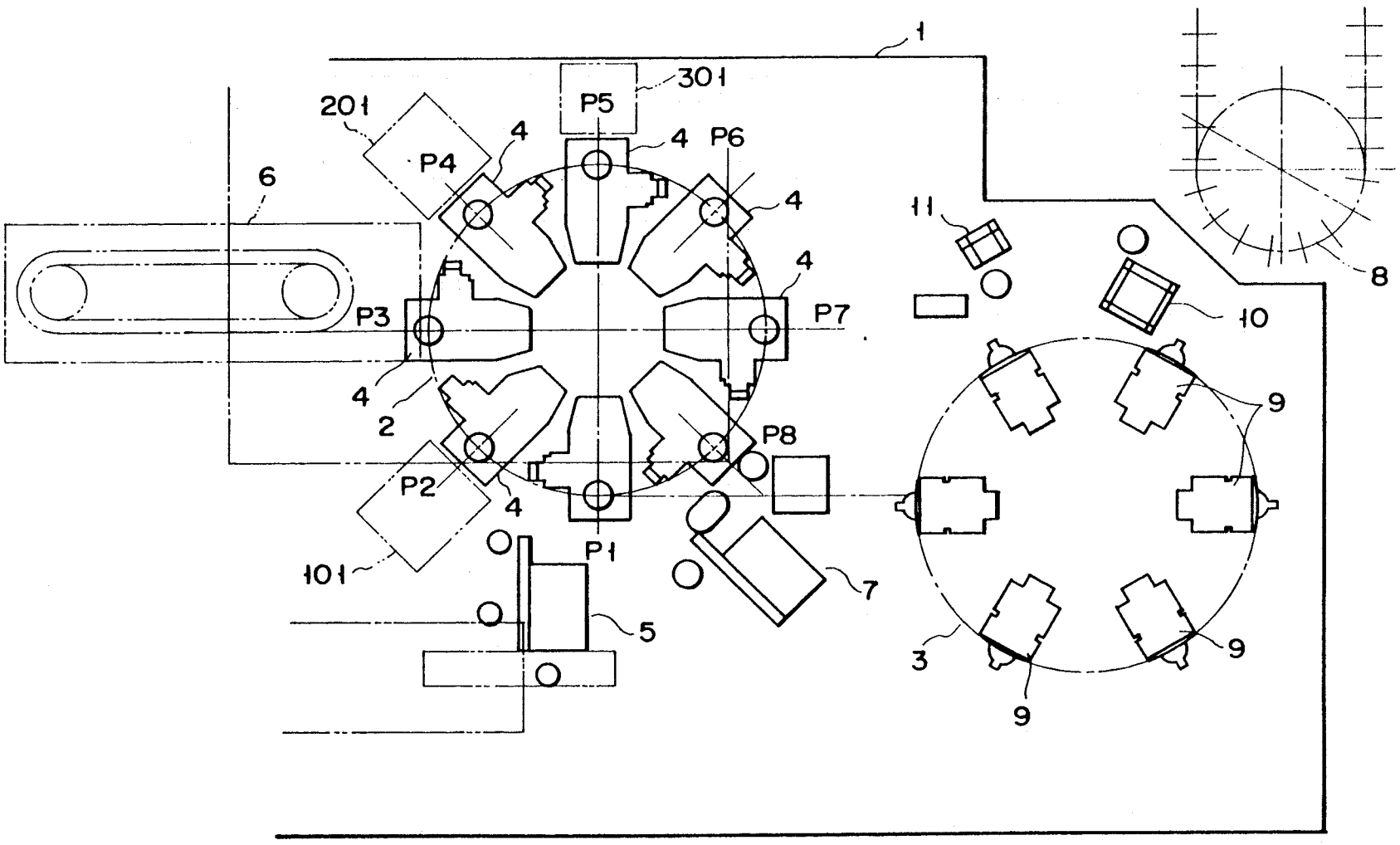
FIG. 1 is a schematic top view showing a reflector lamp manufacturing machine according to the present invention.

FIG. 1 shows a schematic top view of the machine of the present invention.

This machine has the common base 1. The assembling turntable 2 and the bonding/testing turntable 3 are installed on the base 1. Several (e.g. eight) holding heads 4 are arranged on the periphery of said assembling turntable 2. The turntable 2 intermittently stops every ⅛ turns and each stop position is shown by any one of P1 through P8. On these positions P1 through P8, operations to be mentioned later are executed.

The three-axis moving system to be mentioned later is installed on each of said holding heads to move the installed lamp around the reflector in three directions of X, Y, and Z which are orthogonal each other for optical positioning.

A reflector mounting system 5 is arranged closely to the position P1 of the turntable 2

A reflector R (e.g. dichroic mirror) is mounted on each holding head 4 by the reflector mounting system 5.

A lamp mounting system 6 is arranged at the position P3 and the light-source lamp L (e.g. halogen lamp) is mounted on each holding head 4 at the above position.

As mentioned later, the reflector R and lamp L are assembled on the assembling turntable 2 with the specified positional relation and temporarily secured by cement.

A moving system 7 is arranged at the position P8 of the assembling turntable 2 and the temporarily-assembled reflector lamp is moved to several heads 9 installed on said bonding/testing turntable 3 by the moving system 7. Said heads 9 are moved according to rotation of said bonding/testing turntable 3, cement is fed and dried, and test is executed. Reflector lamps passing the test are moved to the ejecting conveyer 8 by the moving system 10 and then to the nest process.

Reflector lamps failing the test are ejected by the disposing system 11.

Figure 2:
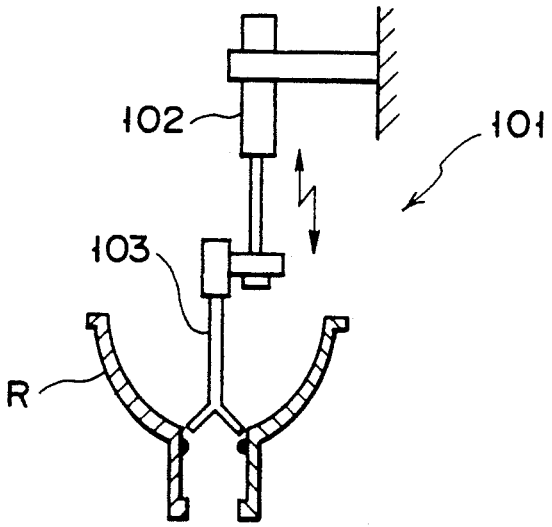
FIG. 2 is a side view of the cement feeding means.

A cement feeding system 101 shown in FIG. 2 is arranged closely to the position P2 of said assembling turntable 2. The cement feeding system 101 has the cylinder system 102 and the nozzle 103.

The nozzle 103 is vertically moved by the cylinder system 102 and cement is fed from the nozzle 103.

When the reflector R, mounted on said holding head 4 is moved to the position P2, said nozzle 103 lowers to feed a small amount of cement to several portions (e.g. three portions) inside the lamp installing portion of the reflector R.

Then, the reflector R is moved up to the position P3 and the lamp L is mounted by said lamp mounting system 6.

Figure 3:
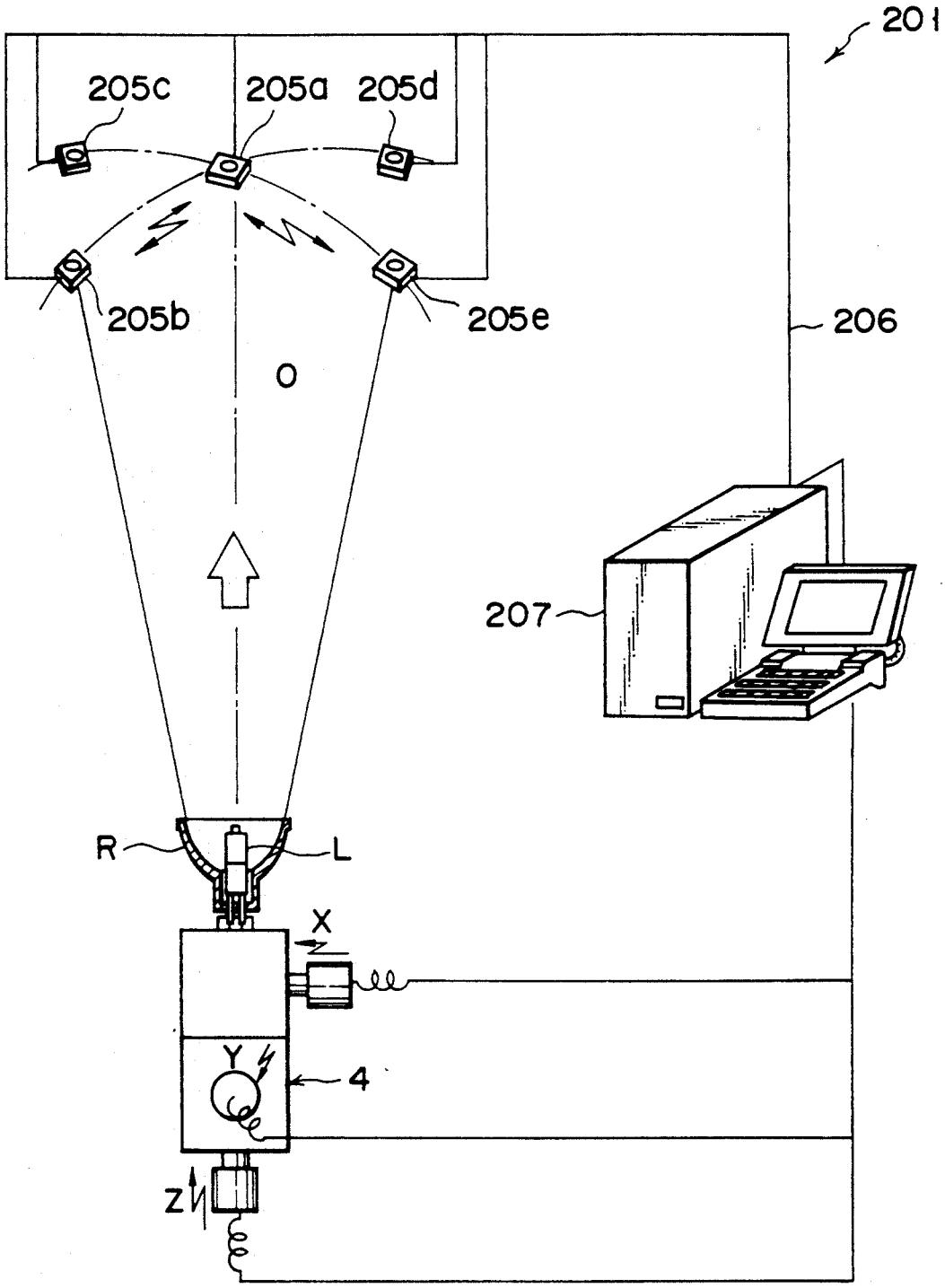
FIG. 3 is a figure schematically showing the entire positioning means.

Said cement is applied between the mounted lamp L and reflector R. Then, the reflector R and lamp L are moved to the position P4 where the lamp L is optically positioned to the reflector R. The configuration of the positioning system 201 is described below according to FIGS. 3 through 5.

Said reflector R is held secure by the holding head 4. Said lamp L is held by the chuck 203 of the moving table 203 at the position of the three-axis moving system 500 of the holding head 4.

Several (e.g. five) photodetectors 205*a* through 205*e* are arranged in front of the held reflector R or at the light projection side. The photodetector 205*a* is arranged on the axis of the reflector R or the optical axis O. Two the photodetectors 205*c* and 205*e* are arranged on the surface along the X direction including the optical axis O.

The photodetectors 205*c* and 205*e* are arranged symmetrically to the optical axis O. The remaining photodetectors 205*b* and 205*d* are arranged on the surface along the Y direction including said optical axis O. The photodetectors 205*b* and 205*d* are arranged symmetrically to the optical axis O.

The illuminance of the light reflected and forward-projected by the reflector R is detected by these photodetectors and the illuminance distribution is measured.

The photodetectors 205*a* through 205*e* are connected to the arithmetic unit 207 by a signal line 206, which calculates optical displacement of said lamp L from the reflector R according to the signals sent from these photodetectors. Said arithmetic unit moves said three-axis moving system 500, and moves the lamp L to the specified position on the reflector R so that correct optical positioning will be achieved.

Figure 4:
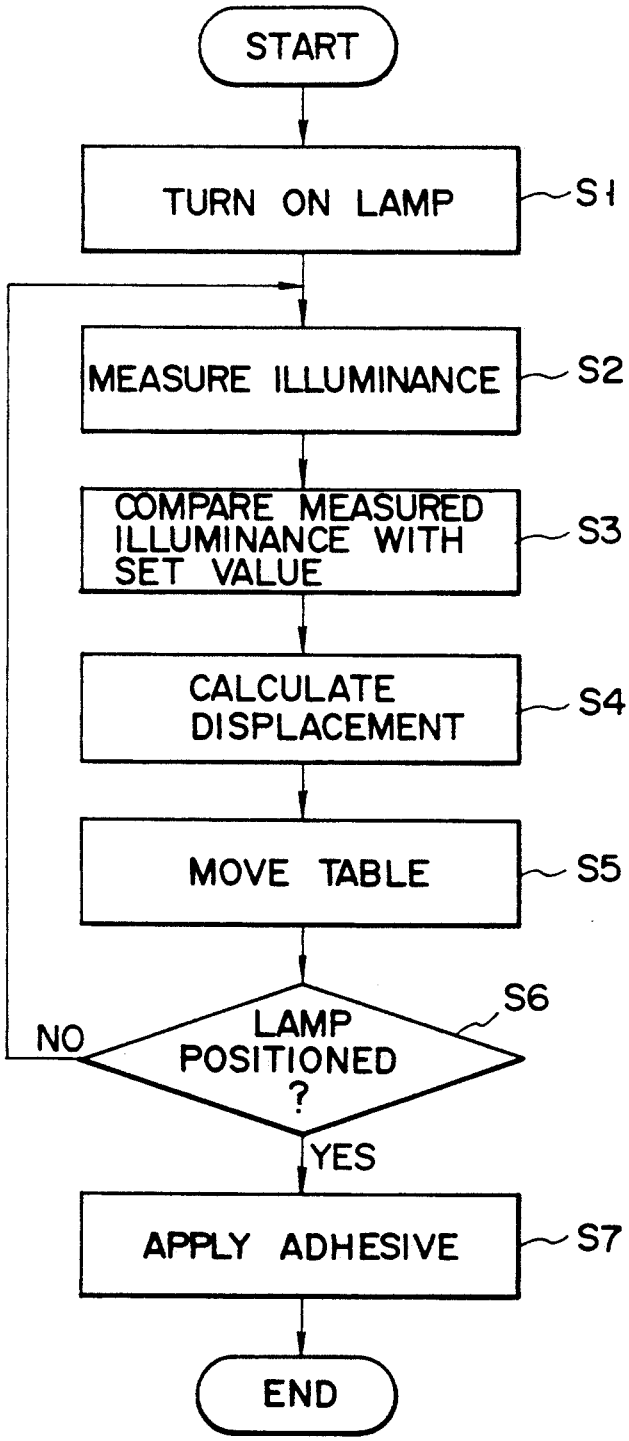
FIG. 4 is a flow chart of the control system of the positioning means.

The following is the description of the optical positioning. FIG. 4 is a flow chart of the above operation. The lamp L is turned on in the step S1 and illuminance is measured by each of said photodetectors in the step S2. The measured value is input to the arithmetic unit 207 and computed in the step S3. This operation is executed, for example, as shown below.

Figure 5A:
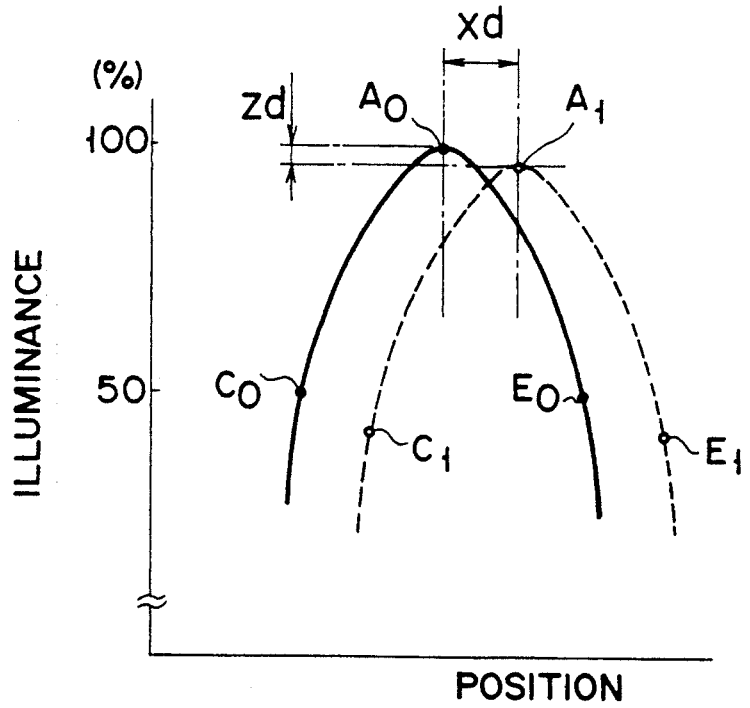
FIGS. 5A and 5B explain the relationship between the luminous intensity distribution characteristic of reflector lamp and the lamp position.
Figure 5B:
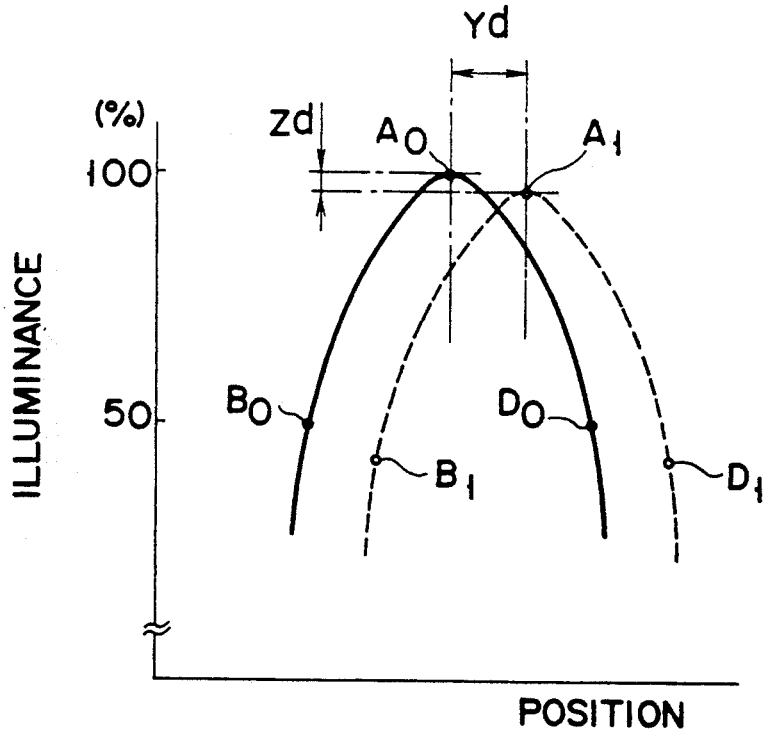

The normal illuminance distribution characteristic when the lamp L is at the correct optical position as shown in FIGS. 5A and 5B is previously input to the arithmetic unit 207. Also, illuminance values at positions of photodetectors {e.g. illuminance values C0 and E0 in the X direction shown in FIG. 5A and illuminance value B0 and D0 in the Y direction shown in FIG. 5B} are stored in the arithmetic unit.

In this embodiment, the luminous intensity distribution characteristic of the reflector lamp shows the line-symmetric luminous intensity distribution characteristics centering around the optical axis O.

As shown by a broken line in FIG. 5A, if the lamp L is displaced from the reflector L and the luminous intensity distribution characteristic is displaced, the measured values C1 and E1 of said photodetectors 205*c* and 205*e* are changed. Thus, the luminous intensity distribution characteristic or the displacement Xd of the lamp L in the X-axis direction is calculated according to the change of C1 and E1 in the step S4 and optical positioning of the lamp L in the X-axis direction is executed by moving the said three-axis moving system 500 in the step 5.

Though the above description is made for the X-axis direction, the same is true for the Y-axis direction.

As shown in FIG. 5B, the measured values B1 and D1 of the photodetectors 205*b* and 205*d* are compared with the reference values B0 and D0 to calculate the displacement Yd in the Y direction for optical positioning of the lamp L in the Y direction.

Optical positioning in the Z-axis direction is made by the measured value of the photodetector 205*a* arranged at the center of the above mentioned. That is, after said positionings in the X- and Y-axis directions are completed, the measured value Al of the photodetector 205*a* on the optical axis O is compared with the reference value A0 to calculate the displacement Zd in the Z-axis direction as shown in FIG. 5A or 5B and the three-axis moving system 500 is operated corresponding to the calculated displacement for optical positioning of the lamp L in the Z-axis direction.

It is confirmed in the step S6 that positioning of the lamp is completed before the lamp L is temporarily secured at the specified position in the step S7.

In this embodiment, the lamp L is temporarily secured by said heating system for heating the fed cement.

Figure 6:
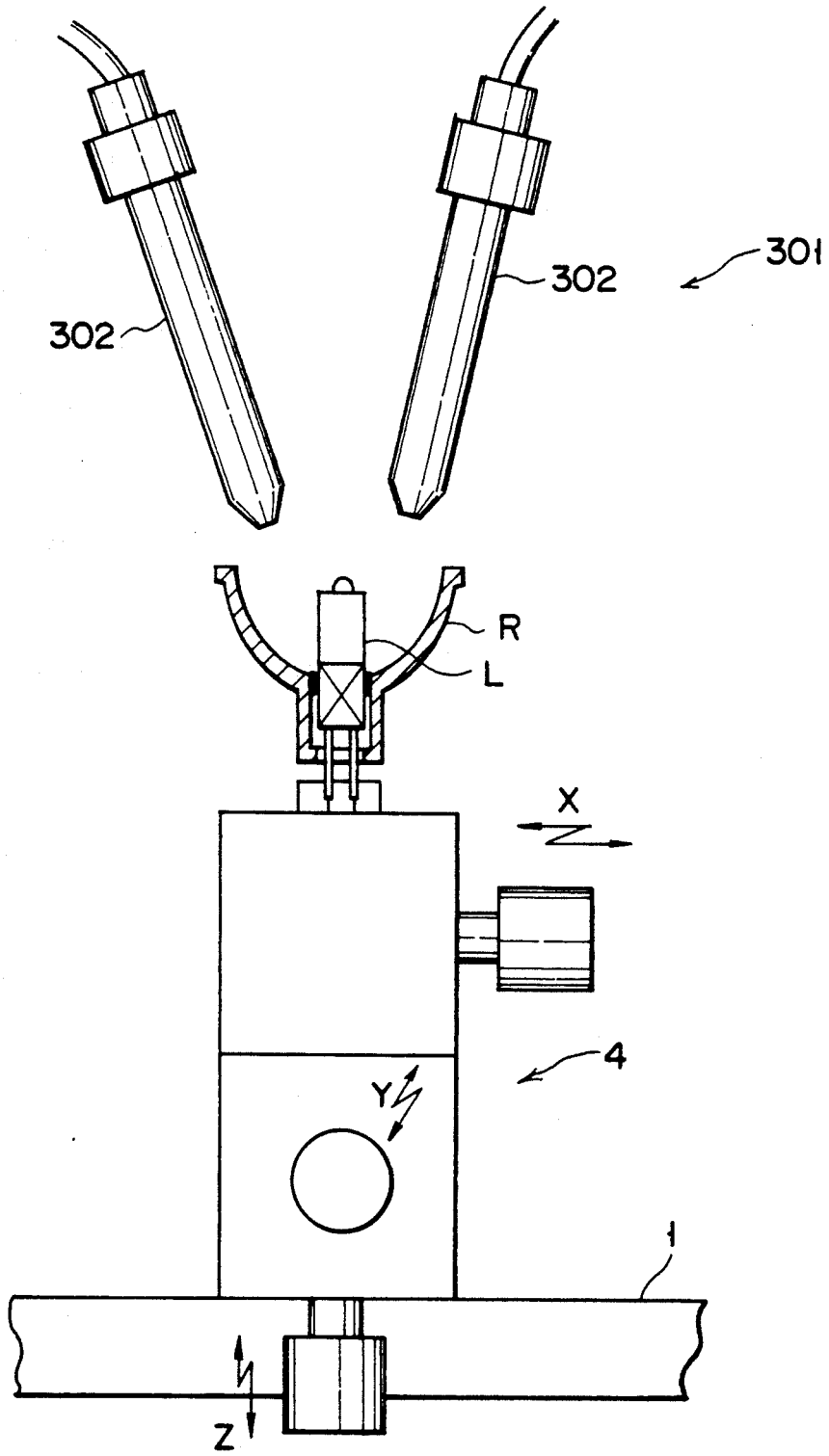
FIG. 6 is a side view of the heating means.

FIG. 6 shows a schematic configuration of the heating system 301.

The heating system 301 is arranged closely to said position P5 or closely to the position P6 or P7 according to necessity. The heating system 301 has several hot-air nozzles 302 which are vertically moved by a known mechanism.

When the lamp L and reflector R positioned in said process are moved to these positions, the hot-air nozzles 302 lower to approach the joint between the lamp L and reflector R and hot air is jetted from the hor-air nozzles 302 to heat and cure the previously-fed cement and temporarily secure the lamp L at the specified position. In this case, it is permitted to turn on the lamp L in order to heat the cement.

Figure 7:
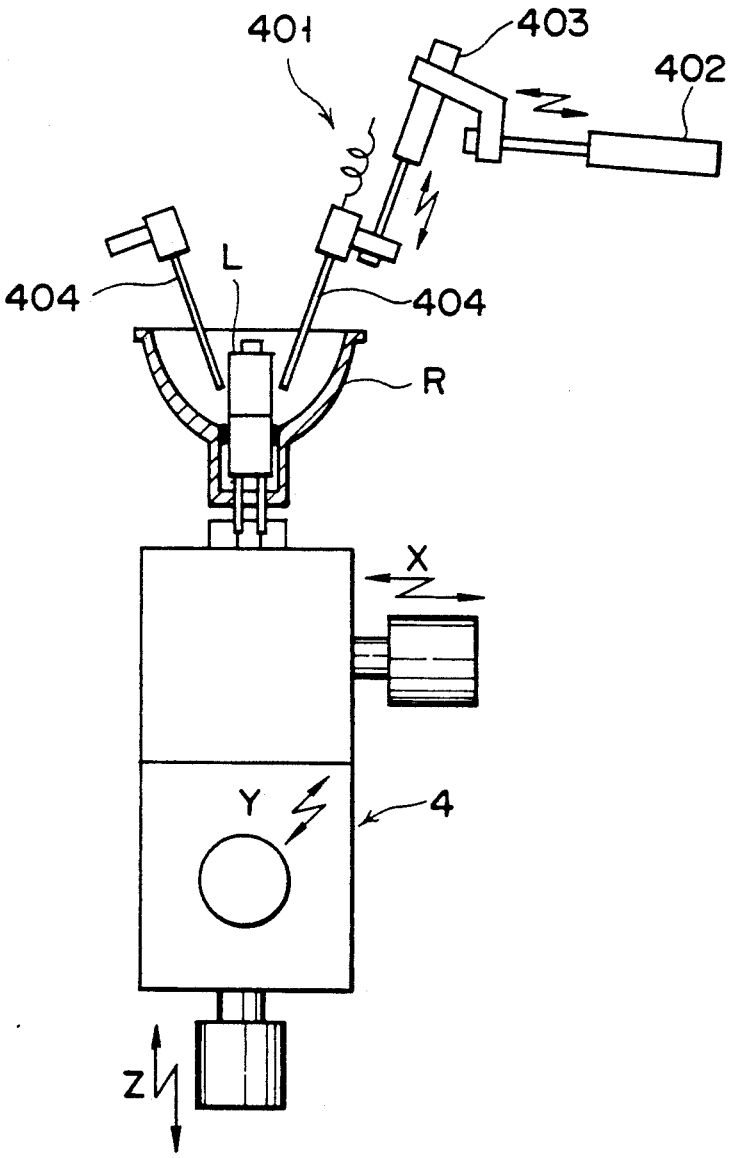
FIG. 7 is a side view of the adhesive feeding means of another embodiment.
Figure 8:
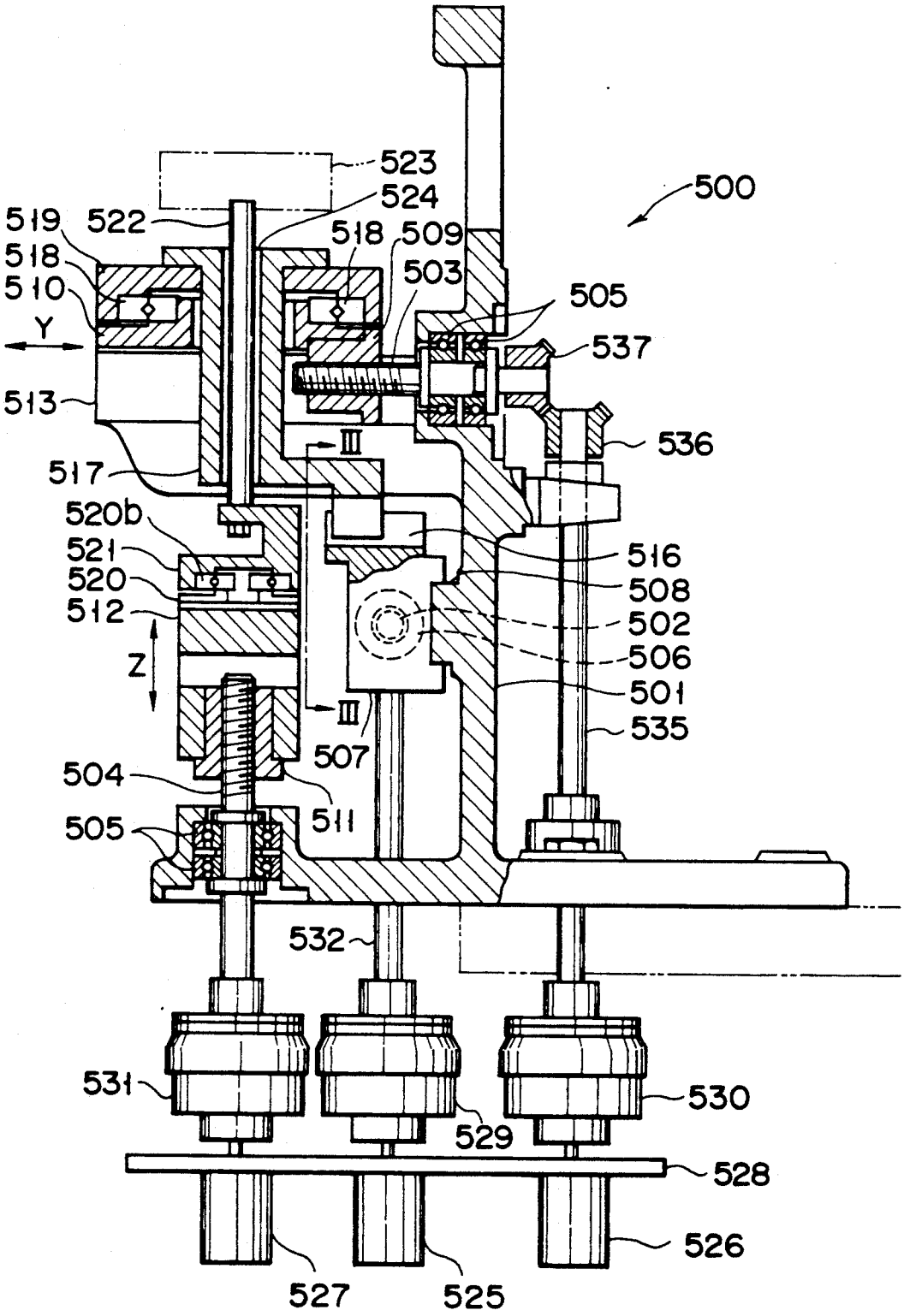
FIG. 8 is a longitudinal section of the three-axis moving means of the holding head.
Figure 9:
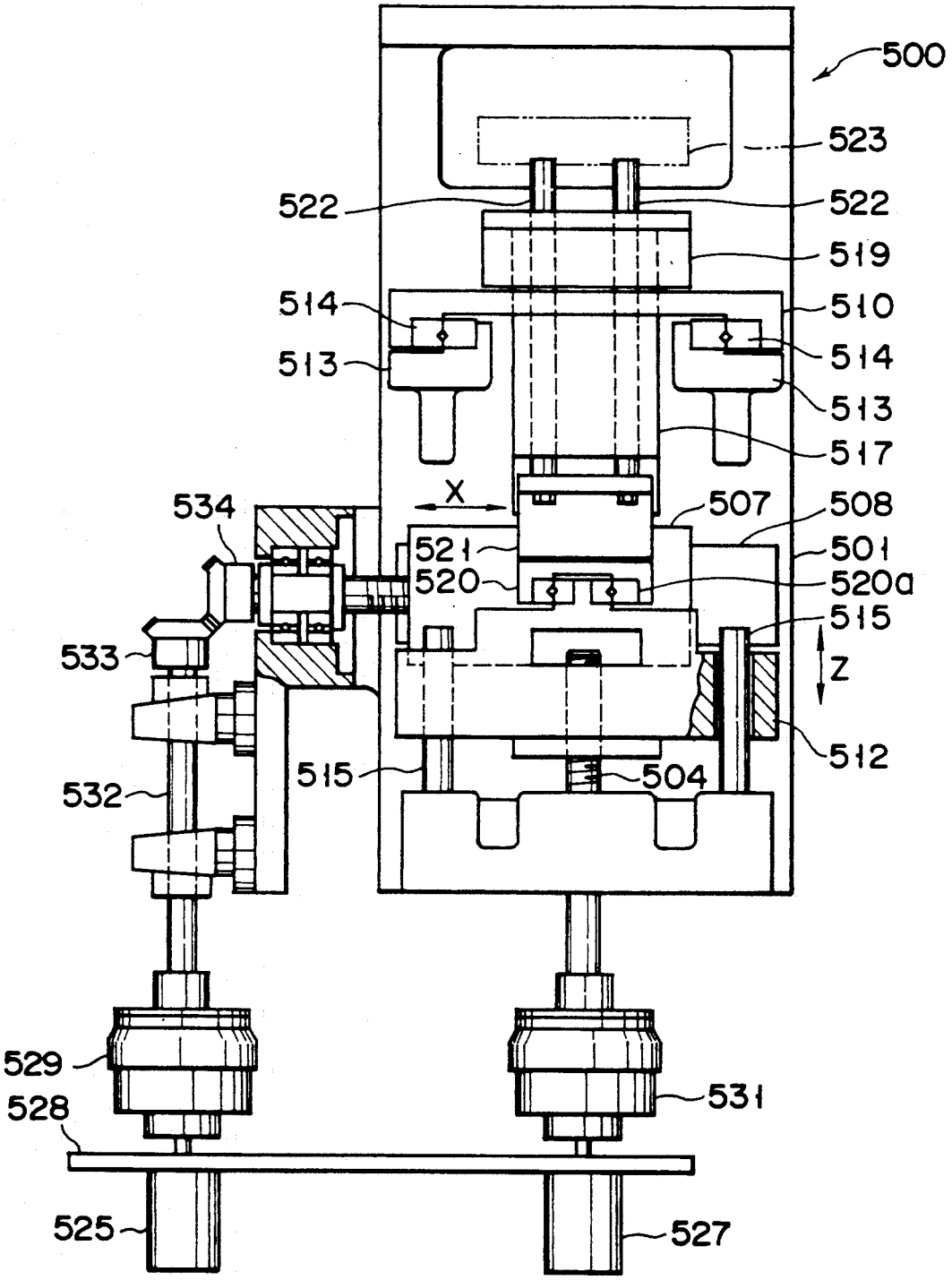
FIG. 9 is a front view of the three-axis moving means.
Figure 10:
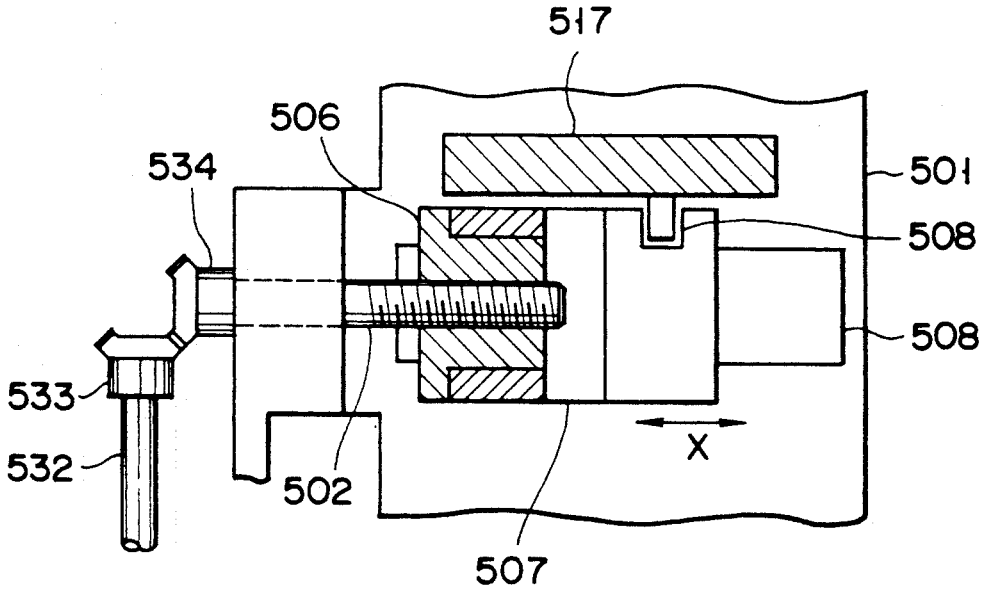
FIG. 10 is a cross section along 10—10 in FIG. 8.
Figure 11:
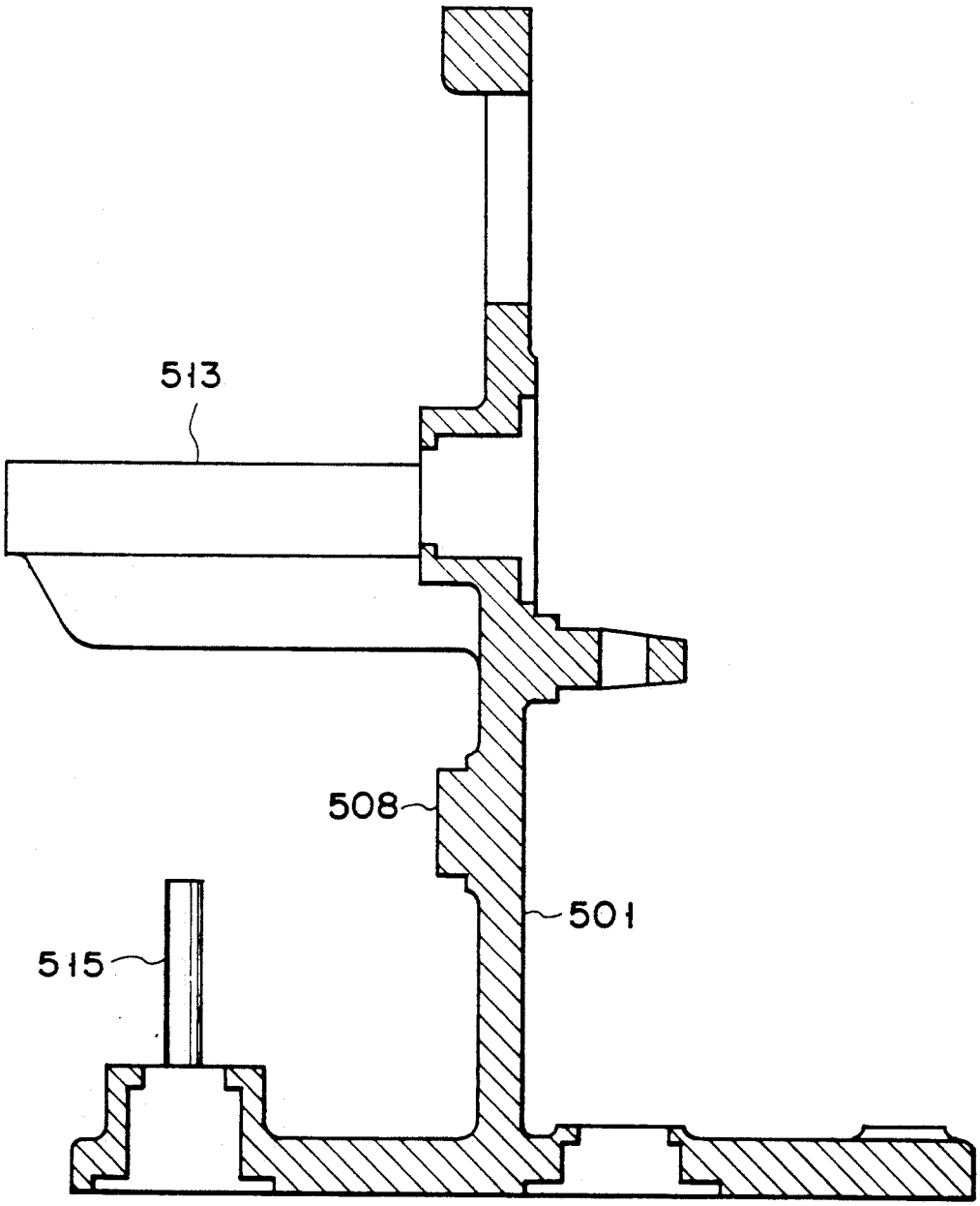
FIG. 11 is a longitudinal section of the frame of the three-axis moving means.
Figure 12:
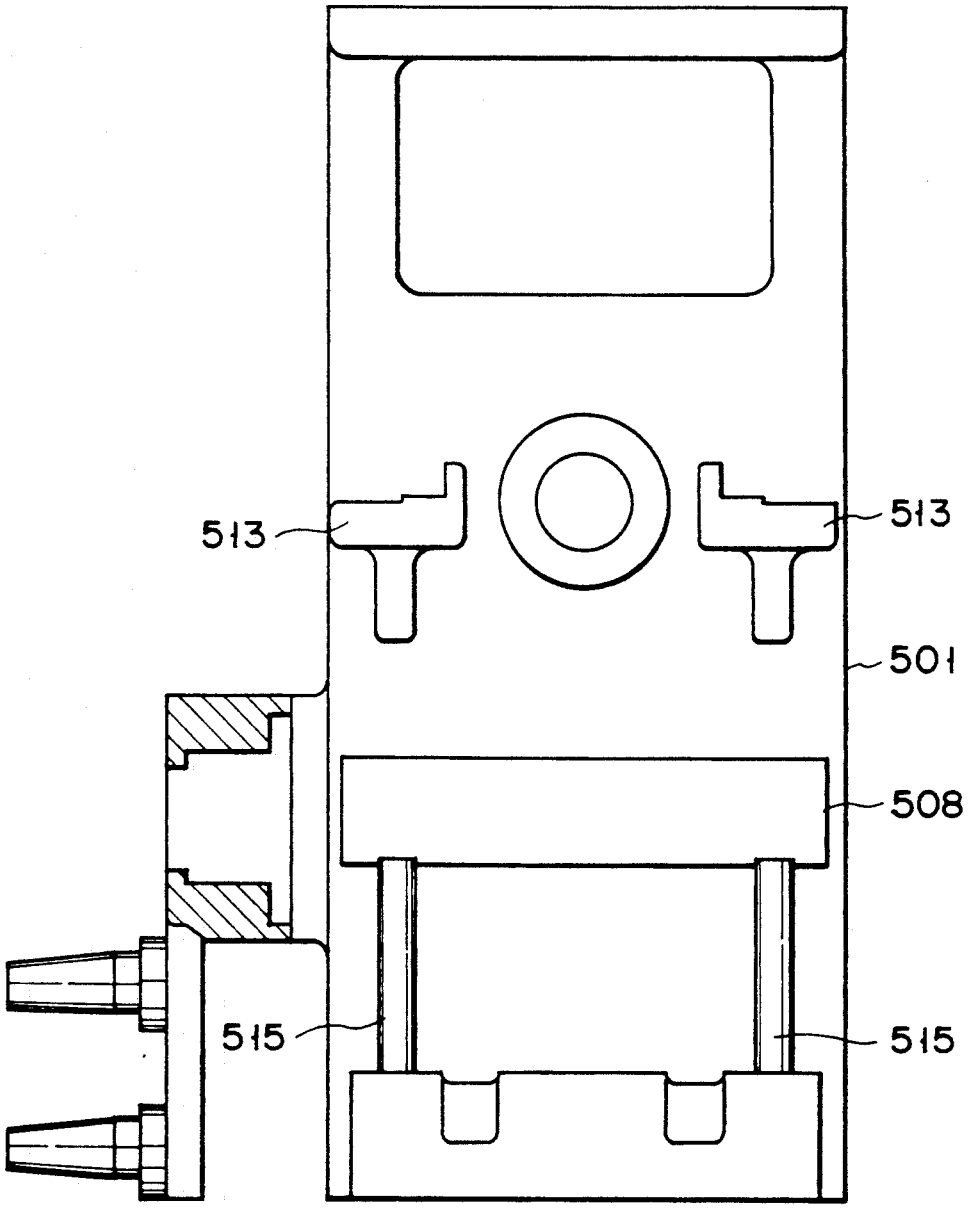
FIG. 12 is a front view of the frame of the three-axis moving means.
Figure 13:
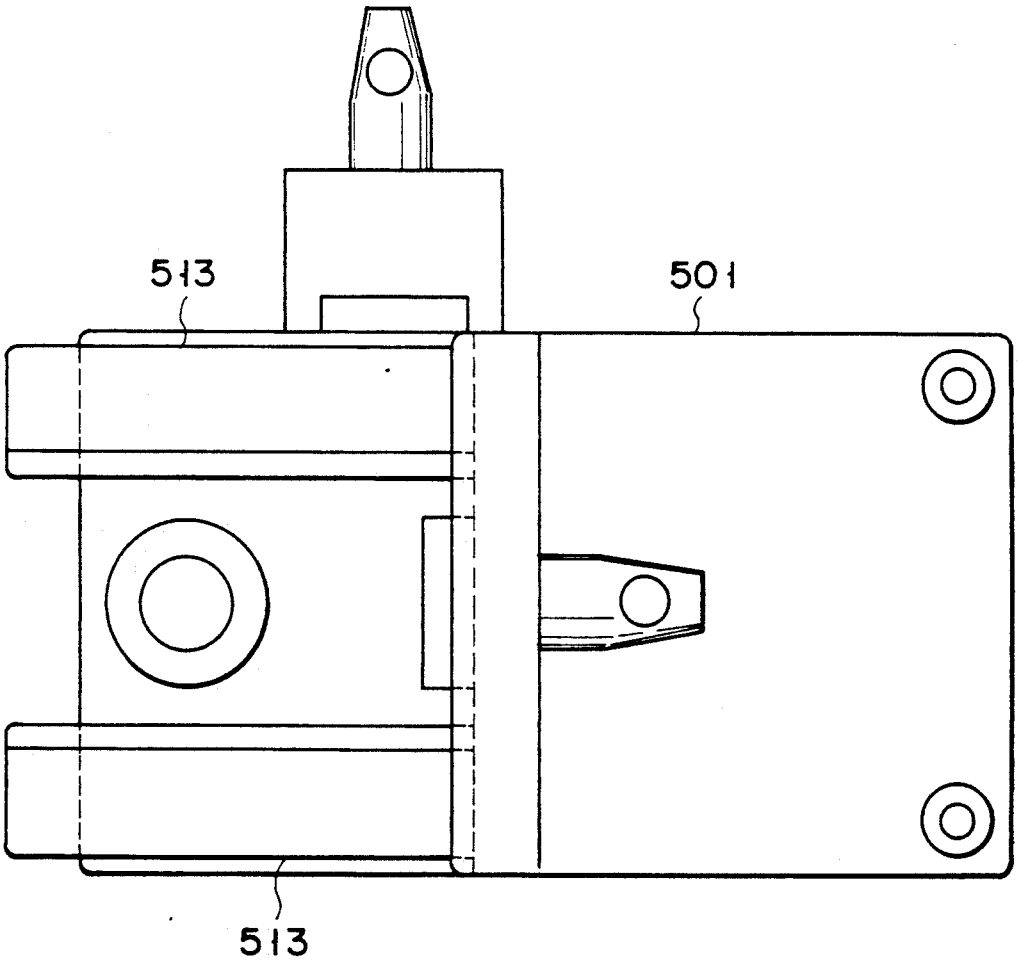
FIG. 13 is a top view of the frame of the three-axis moving means.

FIG. 7 shows another embodiment to temporarily secure the lamp L.

The adhesive feeding system 401 is also shown in FIG. 7. The adhesive feeding system 401 has several nozzles 404 which are horizontally and vertically moved by the horizontally-moving cylinder system 402 and vertically-moving cylinder system 403. The adhesive feeding system 401 is arranged, for example, close to the position P6.

As mentioned above, when the assembly of positioned lamp L and reflector R is moved to the position, said nozzles 404 move horizontally and vertically to approach the joint between the lamp L and reflector R and feed quick-curing adhesive such as instantaneous adhesive to the joint in order to temporarily secure the lamp L at the specified position.

When the instantaneous adhesive is used to temporarily secure the lamp as shown in FIG. 7, the cement feeding system in FIG. 2 and the heating system in FIG. 6 are necessary.

The assembly in which the lamp L is positioned and temporarily secured is moved to the head 9 of the bonding/testing turntable 3 by said moving system 7, where the lamp L is secured by cement and tested.

In said embodiment of the present invention, said three-axis moving system 501 uses a special structure. That is, conventional popular three-axis moving system of this type mounts, for example, a Y-axis slider freely moving in the Y-axis direction, a motor for driving the Y-axis slider, and a driving system such as a decelerator on an X-axis slider freely moving in the X-axis direction, and also mounts a Z-axis slider freely moving in the Z-axis direction and its driving system on the Y-axis slider.

For the above structure, the X-axis slider must bear a very heavy load because the Y-axis slider and its driving system and the Z-axis slider and its driving system are mounted on the x-axis slider.

Thus, the responsiveness of the X-axis slider decreases. Therefore, when the conventional three-axis moving system is used, the lamp positioning speed decreases and the operation speed also decreases.

The three-axis moving system 501 used for the machine of the present invention does not mount any driving system for motors or the like on sliders so that movable parts will be lightweight and responsiveness will be improved by eliminating the above disadvantage.

FIGS. 8 through 13 show the configuration of the three-axis moving system 500. The number 501 represents a frame and the frame 501 is installed on said assembling table 2.

Axis-direction moving systems or feed screws 502, 503, and 504 are installed on the frame 501, which are rotatably supported by the bearing 505.

The feed screws 502 trough 504 are orthogonal to each other and arranged in the X-, Y-, and Z-axis directions respectively. The X feed screw 502 arranged in the X-axis direction connects with the X slider 507 through the nut 506.

The X slider 507 is slidably guided in the X-axis direction by the X guide 508 installed on said frame 501 in the X-axis direction. Therefore, the X slider 507 is moved in the X-axis direction according to rotation of the X feed screw 502.

The Y-axis-directional Y feed screw 503 and the Z-axis-directional Z feed screw 504 connect with the Y-axis-directional Y slider 510 and Z-axis-directional Z slider 512 through the nuts 509 and 511 respectively.

Said Y slider 510 is slidably guided in the Y-axis direction by the Y-axis-directional Y guide 513 installed on said frame 510 through the roller guide 514.

Therefore, the Y slider 512 is moved in the Y-axis direction according to rotation of the Y feed screw 503.

Said Z slider 512 is slidably guided by the Z guide 515 installed on the frame 501 in the Z direction and moved in the Z-axis direction according to rotation of the Z feed screw 4.

The guide groove 516 or the Y-axis-directional slide guide is formed on said X sider 507.

The first slide 517 slidably fits the guide groove 516 and moves in the Y-axis direction.

The roller guide 518 or the X-axis-directional guide is installed on said Y slider 510. The movable part of the roller guide 518 connects with said first slide 517 through the connecting member 519.

The cross roller guide 520 or the X- and Y-axis directional guide is installed on said X slider 512.

The cross roller guide 520 comprises two roller guides 520*a* and 520*b* which are orthogonally arranged in the X- and Y-axis directions.

The movable part of the roller guide 520*b* connects with the second slide 521. The movable part 523 is supported on the second slide 521 through the support axis 522.

Said support axis 522 is slidably inserted into the hole 24 formed on said first slide 517.

The member at the securing side or the mounting plate 528 is arranged under the assembling turntable 2 on which said frame 501 is installed.

The motors 525, 526, and 527 are installed on the mounting plate 528. The electromagnetic clutches 529, 530, and 531 are installed on the output axis of these motors respectively. These electromagnetic clutches completely separate these motors from the transfer axis installed at the side of said frame 501.

Therefore when the electromagnetic clutch is separated, said frame 501 and the member installed on the frame can be moved together with the assembling turntable 2.

Only one set of these motors is installed on said position P4 and these motors are connected to the transfer axis at the side of the frame 501 through said electromagnetic clutches only when the three-axis moving system 500 of each holding head 4 moves to the position P4.

The motor 525 is an X motor to drive the three-axis moving system in the X-axis direction. The X motor 525 is connected to the transfer axis 532 through the electromagnetic clutch 529. The transfer axis 532 is connected to said X feed screw 502 through the bevel gear 533.

Therefore, said X feed screw 502 is driven by the X motor 525. The motor 526 is a Y motor to drive the three-axis moving system in the Y-axis direction. The Y motor 525 is removably connected to the transfer axis 535 through the electromagnetic clutch 530. The transfer axis 535 is connected to the Y feed screw 503 through the bevel gears 536 and 537.

Therefore, the Y feed screw 503 is driven by the Y motor 526.

The motor 527 is a Z motor to drive the three-axis moving system in the Z-axis direction.

The Z motor 527 is connected to said Z feed screw 504 through the electromagnetic clutch 531. Therefore, the Z feed screw 527 is driven by the Z motor 527.

The three-axis moving system 500 operates as mentioned below. When the holding head 4 reaches the position P4, each of said motors is connected to each axis through the electromagnetic clutch.

Then the X feed screw 502 is rotated by the X motor 525 and the X slider 507 moves in the X-axis direction. Thus, the first slider 517 moves in the X-axis direction. Consequently, the support axis 522, second slide 521, and connecting member 519 move in the X direction, and the movable part 23 holding the lamp L moves in the X direction.

The Y feed screw 503 is rotated by the Y motor 526 and the Y slider 510 moves in the Y direction. Therefore, the first slider 517 moves in the Y direction. Consequently, the support axis 522, second slide 521, and connecting member 519 move in the Y direction and said movable part moves in the Y direction.

Also, the Z feed screw 504 is rotated by said Z motor 527 and the Z slider 512 moves in the Z-axis direction. Therefore, the second slider 521 and support axis 522 moves in the Z direction and the movable part 523 moves in the Z direction.

Thus, the movable part 523 holding the lamp L is moved in the X-, Y-, and Z-directions and positioned.

For the three-axis moving system having the above configuration, neither driving motor nor parts are mounted on each slider and the movable part is lightweight. Therefore, the lamp L is quickly positioned with a high responsiveness.

Also, the structure is simple because only one set of driving motors is installed on the position P4 as mentioned above. The present invention can be applied not only to said embodiment but to various embodiments unless they are out of the gist of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A machine for manufacturing reflector lamps having a reflector and a light-source lamp, comprising:

at least one holding head on which said reflector and lamp are held, and which has three-axis moving means for moving said held lamp around said reflector in the directions of three axes X, Y, and Z which are orthogonal to each other, said three-axis moving means having a frame and X, Y, and Z sliders installed on the frame so that said sliders can be freely moved in the directions of three axes, X, Y, and Z, respectfully, said three-axis moving means further comprising:

a Y sliding guide formed on said X slider for guiding said lamp along the Y axis;

an X sliding guide formed on said Y slider for guiding said lamp along the X axis;

a first slide to be guided by said Y sliding guide with respect to said X slider and by said X sliding guide with respect to said Y slider;

a second slider movable along the X and Y axis with respect to said Z slider; and a support shaft connected to said moving part and also to said second slider and slidable along the Z axis with respect to said first slider;

positioning means for optically positioning said lamp on said reflector by measuring the luminous intensity distribution of the light reflected by the reflector and projected forward, calculating optical displacement of the lamp from the reflector according to the luminous intensity distribution and moving the lamp by the distance corresponding to the displacement by said three-axis moving means;

securing means for securing said positioned lamp to the reflector, said securing means comprising a cement feeding means for feeding uncured quick curing cement to a joint between said reflector and lamp after the reflector is mounted on the at least one holding head and before the lamp is mounted on said holding head; and motors mounted to a fixed member for driving said positioning means along said three axes, each of said motors connected to said positioning means by means of connectable joint means when one of said plurality of positioning means is located at a position corresponding to each of said motors;

such that the cement hardens within a time for the plurality of holding heads to make one rotation bout the predetermined cyclical path.

2. A machine according to claim 1, wherein said securing means further comprises heating means for heating and curing said cement after said lamp is mounted on said holding head and optically positioned.

3. A machine according to claim 1, wherein said securing means is adhesive feeding means for feeding quick-curing adhesive between said lamp and reflector after the lamp and reflector are mounted on said holding head and the lamp is optically positioned.

* * * * *